US009175635B2

(12) United States Patent
Novotny

(10) Patent No.: US 9,175,635 B2
(45) Date of Patent: Nov. 3, 2015

(54) TWO-STROKE SPARK-IGNITION ENGINE

(76) Inventor: Zdenek Novotny, Brandys nad Labem (CZ)

( * ) Notice: Subject to any disclaimer, the term of this patent is extended or adjusted under 35 U.S.C. 154(b) by 106 days.

(21) Appl. No.: 13/983,261

(22) PCT Filed: Dec. 22, 2011

(86) PCT No.: PCT/CZ2011/000121
§ 371 (c)(1),
(2), (4) Date: Aug. 1, 2013

(87) PCT Pub. No.: WO2012/116665
PCT Pub. Date: Sep. 7, 2012

(65) Prior Publication Data

US 2015/0083076 A1 Mar. 26, 2015

(30) Foreign Application Priority Data

Feb. 28, 2011 (CZ) ..... PV 2001-104

(51) Int. Cl.
*F02B 15/00* (2006.01)
*F02B 25/00* (2006.01)
(Continued)

(52) U.S. Cl.
CPC ... *F02F 1/22* (2013.01); *F01L 7/04* (2013.01); *F01L 7/12* (2013.01); *F02B 1/10* (2013.01); *F02B 21/00* (2013.01); *F02B 75/02* (2013.01); *F02B 1/04* (2013.01); *F02B 2075/025* (2013.01);
(Continued)

(58) Field of Classification Search
CPC ..... F02B 2075/125; F02B 1/04; F02B 2075/025; F02B 25/14; F02F 2001/245; F02F 2001/45; F02F 1/4214; F02F 1/22
USPC ..... 123/302, 303, 61 V, 65 P, 406.11, 432, 123/430, 433
See application file for complete search history.

(56) References Cited

U.S. PATENT DOCUMENTS 2,197,107 A * 4/1940 Kammer ..... 123/65 VS
2,362,700 A * 11/1944 Kirtland et al. ..... 123/65 VA
(Continued)

FOREIGN PATENT DOCUMENTS

| | | | |
|---|---|---|---|
| DE | 2701182 | A1 | 7/1978 |
| DE | 10239403 | A1 | 4/2003 |
| EP | 0427334 | A1 | 5/1991 |
| EP | 0486282 | A1 | 5/1992 |
| EP | 0965738 | A1 | 12/1999 |
| GB | 351789 | A | 7/1931 |
| GB | 759706 | A | 8/1946 |
| GB | 2410060 | A | 7/2005 |
| JP | 5033673 | A | 2/1993 |
| WO | WO 9813593 | A1 | 4/1998 |

OTHER PUBLICATIONS

Search report issued Jun. 16, 2011 by Czech Patent Office in priority application CZ PV 2011-104, 1 page (no translation available).

*Primary Examiner* — Lindsay Low
*Assistant Examiner* — Syed O Hasan
(74) *Attorney, Agent, or Firm* — Hovey Williams LLP

(57) ABSTRACT

A two-stroke spark-ignition engine with through scavenging, exhaust valves (7), an injection nozzle (5) and sparking plug (6) in the cylinder head is characterized by higher volume efficiency and higher volume output with the possibility of gradual change of timing of air inlet into the engine cylinder (2) from the idle run to the full power. The use of a charger or turbocharger is convenient. Higher volume efficiency is achieved by a limitation of flow of exhaust gas back to the suction part through a gradual change of the inlet section to the engine cylinder (2) and by ensuring a higher air pressure before the inlet section. The change of the inlet section is achieved by a rotary bushing (4) on the cylinder (2) or insert of the engine cylinder (2), the bushing (4) being controlled with a control rod (14) from the throttle pedal.

9 Claims, 2 Drawing Sheets

(51) Int. Cl.

| | |
|---|---|
| ***F02B 3/00*** | (2006.01) |
| ***F02F 1/22*** | (2006.01) |
| ***F01L 7/04*** | (2006.01) |
| ***F01L 7/12*** | (2006.01) |
| ***F02B 1/10*** | (2006.01) |
| ***F02B 21/00*** | (2006.01) |
| ***F02B 75/02*** | (2006.01) |
| *F02B 1/04* | (2006.01) |
| *F02F 1/42* | (2006.01) |

(52) U.S. Cl.

CPC ..... *F02B 2720/136* (2013.01); *F02F 1/4214* (2013.01)

(56) References Cited

U.S. PATENT DOCUMENTS

| | | | | | |
|---|---|---|---|---|---|
| 2,386,607 | A | * | 10/1945 | Heintz | 123/55.4 |
| 2,810,373 | A | | 10/1957 | Lang | |
| 3,039,448 | A | * | 6/1962 | Stucke | 123/59.3 |
| 3,309,865 | A | | 3/1967 | Kauffmann et al. | |
| 3,948,241 | A | * | 4/1976 | Melchior | 123/190.12 |
| 4,481,917 | A | * | 11/1984 | Rus et al. | 123/190.12 |
| 5,870,982 | A | | 2/1999 | Strawz | |
| 6,513,464 | B1 | | 2/2003 | Busch | |
| 2011/0030654 | A1 | | 2/2011 | Taylor | |

* cited by examiner

TWO-STROKE SPARK-IGNITION ENGINE

This is a national stage application under 35 U.S.C. §371 of International Application PCT/CZ2011/000121 filed 22 Dec. 2011, which claims the benefit of Czech Republic application Serial No. PV 2011-104 filed 28 Feb. 2011, the entire disclosures of which are incorporated herein by reference.

FIELD OF THE INVENTION

The invention deals with a two-stroke spark-ignition engine for use in a car, motorbike, sports or tourist aircraft or as the drive of industrial units.

BACKGROUND OF THE INVENTION

In existing two-stroke spark-ignition engines the engine cylinder is filled via the crankcase with throttling of inlet air by a throttle valve in the suction pipeline or carburettor. A disadvantage of the current state of the art is imperfect scavenging of the cylinder with fresh air or a fresh mixture of air with fuel and low volume efficiency, which results in a lower power output per liter and higher fuel consumption.

SUMMARY OF THE INVENTION

The principle of the invention is that the inlet air is throttled with a rotary bushing right at the inlet of the engine cylinder with the possibility of changing the timing of the start and end of air inlet into the engine cylinder and reduction of blowing of combustion products into the storage area filled by the charger or the engine crankcase. By the creation of sufficient pressure of fresh air before the cylinder entry with the use of a charger (i.e. a supercharger) or turbocharger the penetration of the combustion products is reduced even if the channels of the engine cylinder are fully open and filling of the cylinder with fresh air is improved. The injection of fuel through the fuel nozzle at the moment the engine piston has passed the bottom dead centre prevents fuel losses with the possibility to produce a stratified mixture with ignition consistency at the sparking plug in the cylinder head.

BRIEF DESCRIPTION OF THE DRAWINGS

An example embodiment of the above mentioned invention is schematically illustrated in the attached drawings.

EXAMPLES OF EMBODIMENT OF THE INVENTION

Figure 1:
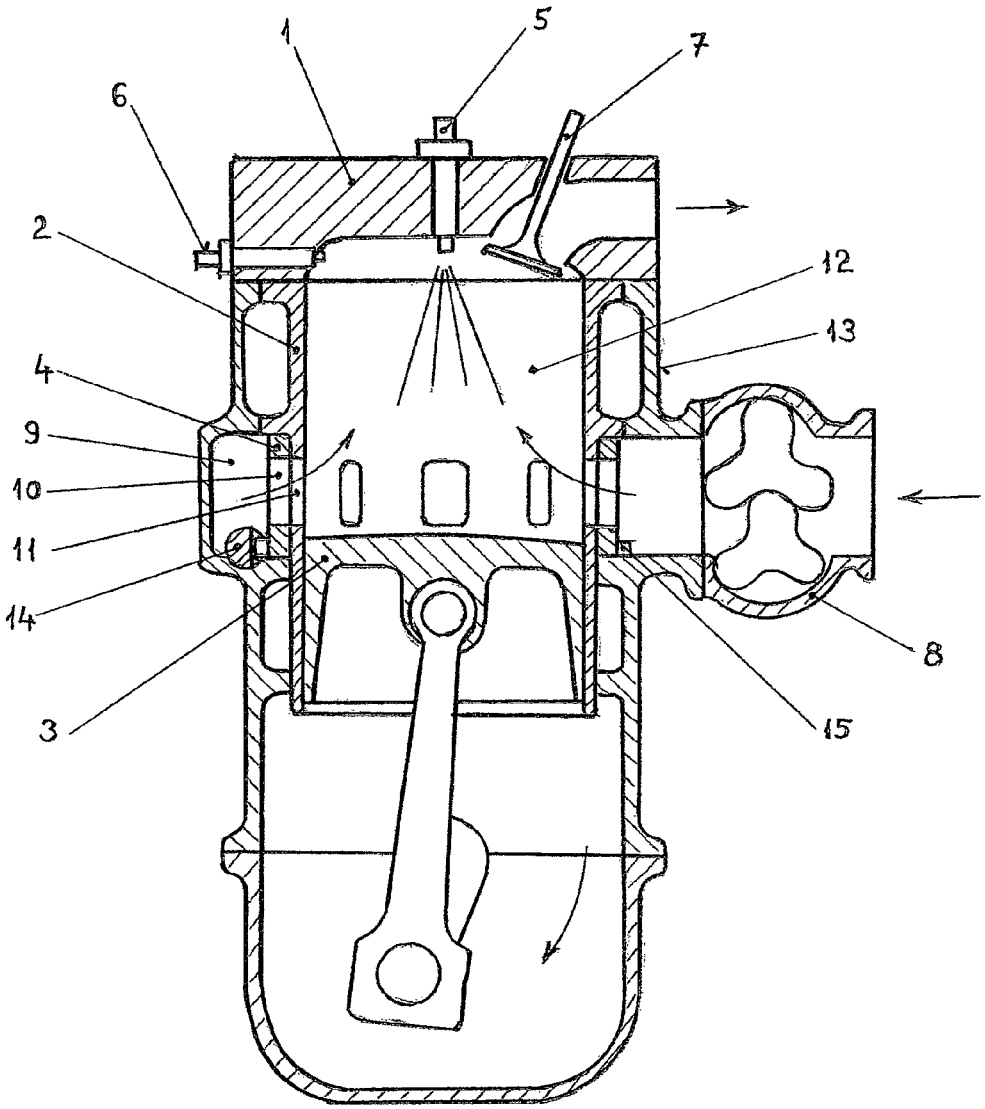
FIG. 1 schematically presents a section of the engine.
Figure 2:
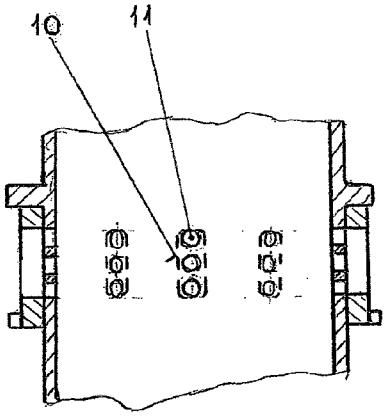
FIG. 2 is a fragmentary view showing the position of the inlet openings in the cylinder and throttling openings in the bushing.
Figure 3:
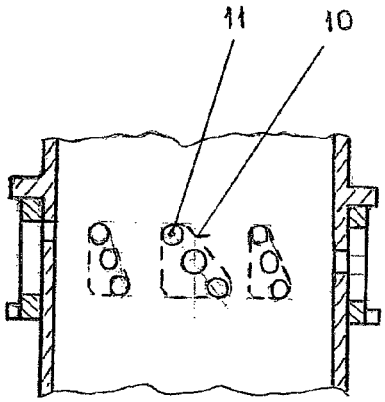
FIG. 3 is a fragmentary view showing the position of the inlet openings in the cylinder and throttling openings in the bushing.
Figure 4:
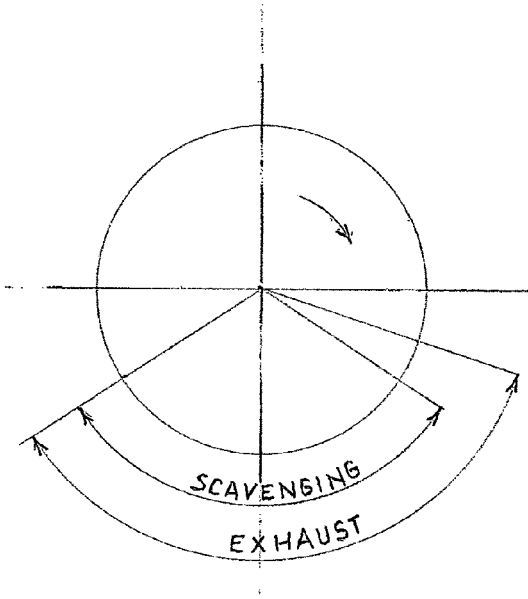
FIG. 4 presents a distribution diagram for fully open channels in the full throttle mode.
Figure 5:
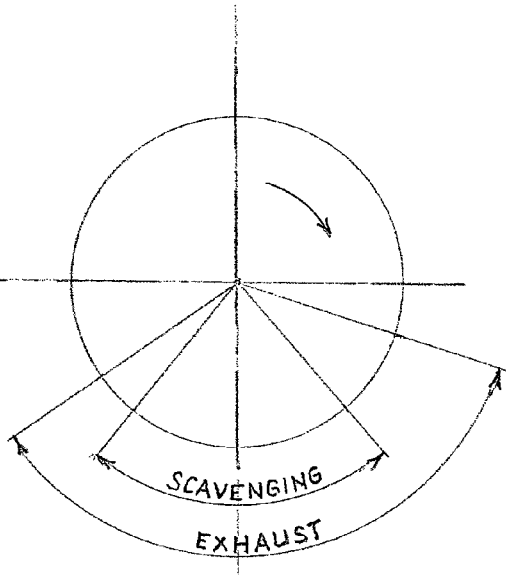
FIG. 5 shows a distribution diagram for partially throttled throttle openings of the bushing in an idle run mode.

The two-stroke spark-ignition engine consists of the cylinder head 1 in which exhaust valves 7 are mounted in a slidingway and an injection nozzle 5 and sparking plug 6 is attached.

In the cylinder block 13 a cylinder 2 is pressed in along the perimeter of which inlet openings 11 are created. In the cylinder 2 a piston 3 moves in a sliding way the movement of which is derived from the crank mechanism. In the space of the inlet openings 11 from the outside of the cylinder 2 a bushing 4 is mounted in a rotary way the perimeter of which contains throttle openings 10. In the bottom part of the bushing 4 there is a gear ring 15 that is firmly attached to it to the teeth, of which the teeth of a control rod 14 engage. The movement of the control rod 14 ensures rotary adjustment of the bushing 4. The control rod 14 is mounted in a sliding way in the cylinder block 13 and is controlled by the throttle pedal. In the cylinder block 13 an annular storage space 9 is created that is filled with fresh air from the charger 8 or the crankcase. The air enters the compression space 12 from the storage space 9 through the throttle openings 10 and inlet openings 11 and is compressed by the piston 3.

The two-stroke spark-ignition engine works in such a way that fresh air from the crankcase or the charger 8 is driven under pressure to the storage space 9 and from there, when the inlet openings 11 are open, it flows through the piston 3 during its movement to the bottom dead centre via the throttle openings and inlet openings 11 to the compression space 12 and forces the exhaust gases via the exhaust valves 7 to the exhaust pipeline. When the piston 3 moves from the bottom dead centre and starts to compress the air in the cylinder 2 and closes the inlet openings 11, the injection nozzle 5 injects finely sprayed fuel into the compressed air on simultaneous closing of the exhaust valves 7. The compressed homogeneous mixture is ignited by the sparking plug 6 before the top dead centre. To create a stratified mixture the ignition mixture must be rotated by the tangential air inlets into the compression space 12.

The power of the engine is changed by rotary adjustment of the bushing 4 which changes the cross-section of the inlet openings 11 and thus the amount of air in the compressions space 12. The rotary adjustment of the bushing 4 is done by the control rod 14 the teeth of which engage into the teeth of the gear ring 15. The control rod 14 is moved by the throttle pedal. Changing of the timing of the beginning and end of air inlet into the compression space 12 is ensured in such a way that the circular inlet openings 11 in the engine cylinder 2 are evenly distributed on the perimeter in several rows over each other, individual rows being offset by an angle with regard to each other. The rows are offset in such a way that the bottom row is the first one to be opened while the last row, which is the nearest to the top dead centre of the piston 3, is the last one to be opened.

The throttle openings 10 have a triangular shape which ensures opening of all the inlet openings 11 in all the rows at the fully open throttle without throttling. In the idle mode only the inlet openings 11 in the bottom row towards the bottom dead centre are only open, being in addition partly closed by the throttle openings 10 in the bushing 4. At the expansion stroke of the piston 3 the piston only opens the bottom row of the inlet openings 11, which causes a delay of the inlet start and accelerates the end of the inlet because the other rows of openings are covered by the bushing 4.

INDUSTRIAL APPLICABILITY

A two-stroke spark-ignition engine in accordance with the invention can be used in the automotive, motorbike and aviation industry.

The invention claimed is:

1. A two-stroke spark-ignition engine with through scavenging, comprising:

an engine cylinder having a cylinder perimeter and exhaust valves;

an injection nozzle;

a storage space with pressurized air;

a cylinder head;

a sparking plug in the cylinder head; and a bushing having a perimeter, wherein the bushing is rotatably mounted on an outside of the engine cylinder and provided with throttle openings on a perimeter of the bushing and wherein a plurality of inlet openings are arranged on the cylinder perimeter in a plurality of vertically spaced rows arranged one over the other and including at least a top row and a bottom row, and wherein the bushing is rotatably adjustably mounted on the engine cylinder wherein by rotary adjustment of the bushing, the inlet openings of the bottom row are the first of said plurality of rows to be opened and the inlet openings of the top row are the last to be opened for enabling passage of pressurized air from the storage space into the compression space of the engine cylinder, wherein the inlet openings are circular and the throttle openings have a triangular shape.

2. The two-stroke spark-ignition engine according to claim 1, wherein the inlet openings in each of the rows are arranged on vertical axes and are opened by an oblique edge of the throttle openings.

3. The two-stroke spark-ignition engine according to claim 1, wherein the plurality of rows including individual rows of the inlet openings, and wherein each one of the individual rows of the inlet openings are offset by an angle with regard to the other of the individual rows and the inlet openings are opened by a vertical edge of the throttle openings.

4. The two-stroke spark-ignition engine according to claim 1, wherein the bushing is provided with a gear ring that is firmly attached to the bushing, the gear ring including a plurality of gear ring teeth, and further including a control rod having a plurality of teeth, wherein the gear ring teeth engage the teeth of the control rod, the control rod being slidably mounted in the cylinder block and operatively controlled by a throttle input device.

5. The two-stroke spark-ignition engine according to claim 1, wherein the bushing is provided with a gear ring that is firmly attached to the bushing, the gear ring including a plurality of gear ring teeth, and further including a control rod having a plurality of teeth, wherein the gear ring teeth engage the teeth of the control rod, the control rod being slidably mounted in the cylinder block and operatively controlled by a throttle input device.

6. The two-stroke spark-ignition engine according to claim 2, wherein the bushing is provided with a gear ring that is firmly attached to the bushing, the gear ring including a plurality of gear ring teeth, and further including a control rod having a plurality of teeth, wherein the gear ring teeth engage the teeth of the control rod, the control rod being slidably mounted in the cylinder block and operatively controlled by a throttle input device.

7. The two-stroke spark-ignition engine according to claim 3, wherein the bushing is provided with a gear ring that is firmly attached to the bushing, the gear ring including a plurality of gear ring teeth, and further including a control rod having a plurality of teeth, wherein the gear ring teeth engage the teeth of the control rod, the control rod being slidably mounted in the cylinder block and operatively controlled by a throttle input device.

8. A two-stroke spark-ignition engine with through scavenging, comprising:

an engine cylinder having a cylinder perimeter and exhaust valves;

an injection nozzle;

a storage space with pressurized air;

a cylinder head;

a sparking plug in the cylinder head; and a bushing having a perimeter, wherein the bushing is rotatably mounted on an outside of the engine cylinder and is provided with throttle openings on its perimeter, and wherein a plurality of inlet openings are arranged on the cylinder perimeter in a plurality of vertically spaced rows arranged one over the other and including at least a top row and a bottom row, and wherein the bushing is rotatably adjustably mounted on the engine cylinder wherein by rotary adjustment of the bushing, the inlet openings of the bottom row are the first of said plurality of rows to be opened and the inlet openings of the top row are the last to be opened for enabling passage of pressurized air from the storage space into the compression space of the engine cylinder, wherein a particular alignment position of the throttle openings of the bushing with one or more of the rows of the inlet openings on the cylinder is controlled by rotary adjustment of the bushing via a throttle input device, wherein the inlet openings are circular and the throttle openings have a triangular shape.

9. The two-stroke spark-ignition engine according to claim 8, wherein the rotation adjustment of the bushing is controlled by a throttle pedal.

* * * * *